US006135445A

United States Patent [19]

Gamperling et al.

[11] Patent Number: 6,135,445

[45] Date of Patent: Oct. 24, 2000

[54] APPARATUS FOR FORMING STACKS

[75] Inventors: Peter Gamperling, Bammental; Erich Michael Zahn, Eppelheim, both of Germany

[73] Assignee: Heidelberger Druckmaschinen AG, Heidelberg, Germany

[21] Appl. No.: 09/282,038

[22] Filed: Mar. 30, 1999

[30] Foreign Application Priority Data

Mar. 30, 1998 [DE] Germany ..... 198 14 236

[51] Int. Cl.[7] ..... B65H 31/26

[52] U.S. Cl. ..... 271/220; 414/790.8

[58] Field of Search ..... 271/207, 211, 271/213, 214, 217, 218, 220, 224; 414/789.9, 790.8

[56] References Cited

U.S. PATENT DOCUMENTS 4,452,442 6/1984 Geschwindner et al. ..... 271/218 X
4,469,321 9/1984 Geschwindner ..... 271/218 X
4,509,740 4/1985 Foresi et al. ..... 271/224
4,787,621 11/1988 Sattler ..... 271/224 X
4,813,661 3/1989 Wegel et al. ..... 271/224 X
5,433,429 7/1995 Muller ..... 271/218 X

*Primary Examiner*—David H. Bollinger
*Attorney, Agent, or Firm*—Herbert L. Lerner; Laurence A. Greenberg; Werner H. Stemer

[57] ABSTRACT

The sheet-stacking apparatus stacks sheets arriving in a stream of successive sheets. A stop face configuration is pivotable, about a geometric pivot axis located at a predetermined level and oriented crosswise to the stream, between a working position wherein it stops the sheets and a position that is pivoted away from it. The system enables accurate, straight-edged stacks, both in the successive buildup of one stack and in the formation of a succeeding stack without interrupting the stream of sheets. In a first variant a carrier profile is provided, which is located above the pivot axis in the working position and past which, in the working position, stop face segments protrude downward in comb-like fashion. In a second variant, a carrier profile with auxiliary stops protruding past it is disposed, adjustable in height, below the pivot axis.

6 Claims, 6 Drawing Sheets

IIIb
9.1
7'
6
1.1
1'
1
14
9
21
20
8
10'
7
15
ΔN
A
1.2
N1
N2
N3
α
15'
8.1
8.2

APPARATUS FOR FORMING STACKS

BACKGROUND OF THE INVENTION

Field of the Invention

The invention lies in the printing field and related paper handling systems. Specifically, the invention relates to an apparatus for forming stacks from a stream of successive sheets. A geometric pivot axis is defined at a predetermined level, oriented crosswise to the direction of the stream, and formed by means of rotary bearing parts. A stop face configuration is located substantially above the geometric pivot axis and is pivotable with respect to the geometric pivot axis between a working position that stops the sheets and a position pivoted away from it. The invention also pertains to a delivery system in a sheet-fed printing press that is equipped with the stack forming apparatus.

Apparatuses of this type are known for instance in sheet-fed printing presses that are commercially available from Heidelberger Druckmaschinen AG of Germany (model number SM102). Here the geometric pivot axis is formed by the longitudinal axis of a stop shaft that is connected to stops in a manner fixed against relative rotation and that with respect to the stops pivoted into their vertical working position is located at the lower end of these stops. The system comprising the stop shaft and the stops thus has a "bottom" stop shaft. The stops form a stop face configuration, which serves to stop the leading edges of the sheets that are downstream in terms of the stream of sheets and to align them in a stack.

In modern printing presses, the aforementioned stream of successive sheets is not interrupted even if a "finished" stack formed of the sheets is taken out of range of the printing press where the stack was formed—from the delivery system of the printing press—in order to make space for forming the next stack. The "finished" stack, depending on the stacking mode, may be a homogeneous configuration—composed exclusively of sheets stacked on one another—resting on a stack underlay in the form of a pallet, or a so-called cradle stack. In a cradle stack a further stack underlay rests on posts that are seated on a previous stack underlay, and a partial stack whose height is less than that of the posts rests on a given stack underlay, and in which so-called cradle boards are used as a given stack underlay, of which the board carrying the lowermost partial stack rests in turn on a pallet, for instance.

The total height of the "finished" stack is dimensioned such that, depending on the design of the printing press, it can be fed out of the delivery system in the direction of travel of the sheets through the printing press or in a direction crosswise to it. Meanwhile, other sheets arriving from the stream, depending on the stacking mode, are deposited on a further board or cradle board set down on an empty pallet as operation continues, or on an auxiliary stack carrier, particularly in the form of a rake, that temporarily carries a certain number of sheets. From the auxiliary stack carrier, as operation continues, an auxiliary stack formed on it is transferred to a further stack underlay in the form of a pallet.

It will be understood that the applicable further board or cradle board or rake, during stack formation on a previous board or cradle board or a previous stack underlay in the form of a pallet, is located outside the stream of sheets and must be moved into this stream if it is to be used as intended. This is done in a region of the stream of sheets in which the sheets are moving downward while being oriented essentially horizontally, while they move at a defined deposition speed toward the stops, specifically by horizontal insertion of the respective board, cradle board or rake between two successive sheets. The trailing sheet is prevented from moving downward, at least for the duration of the insertion, at one end of the sheet pointing counter to the direction of the insertion, by means of a sheet catcher or so-called sheet upholder. To this end, the sheet upholders are also brought out of an outset position, where they are located outside the stream of sheets, into the stream for the aforementioned length of time and are then returned to their outset position immediately after the insertion of the further board, cradle board or rake has been completed. The insertion is typically done the stack, which at that time is located below the sheet catcher, is lowered by an amount determined such that the further board or the further cradle board or the rake can be inserted without contacting the topmost sheet of the stack.

In the event that a further board or the rake has been inserted, the stack then located under the sheet catcher is a finished stack, which can then be transported out of the delivery system. Once the finished stack has been transported out of the delivery system, a further stack underlay should be moved into the delivery system and lifted, by a main stack lifter, to a level at which the board, with a partial stack formed on it in the mean time, or a partial stack formed in the meantime on the rake, can be taken over by the further stack underlay. The aforementioned partial stack can by that time, depending on the thickness of the sheets and the speed with which the sheets succeed one another, attain a more or less great height. This circumstance is typically addressed with an auxiliary stack lifter, by means of which guides that receive the further board or the rake are adjustable in height between an insertion level, at which the insertion as described takes place, and a lower level than the insertion level, at which lower level the aforementioned takeover by the further stack underlay takes place.

The auxiliary stack lifter initially keeps the aforementioned guides, and thus the inserted further board or rake, at the insertion level, specifically until a topmost sheet of a partial stack, now being built up on the further board or on the rack, has regained the production level, at which the sheets are deposited on the lowered stack before the stack is lowered. The time required for this is available then for transporting the lowered stack out of the delivery system, because the auxiliary stack lifter lowers the further board or the rake in proportion with the cadence of the successive sheets, so that the aforementioned production level is now maintained.

In the event that a further cradle board has been inserted, the stack located below the sheet catcher is either a finished cradle stack intended for transport out of the delivery system, or a cradle stack which has not yet reached its intended total height but whose topmost partial stack has reached its respective maximum height.

Regardless of whether the cradle stack is a finished stack or a still unfinished stack, the insertion of a further cradle board and its support in turn on posts set on a preceding cradle board, or its takeover by a platform raised by the main stack lifting mechanism requires a certain amount of time, within which, just as in the case described where a further board or the rake has been inserted, a partial stack of a certain height can form on the further cradle board, so that once again a lowering of the further cradle board adapted to the cadence of the successive sheets is appropriate, once the topmost sheet of the partial stack has reached the aforementioned production level.

Regardless of the stacking mode, this lowering is now one of the reasons why the rake or a further board or cradle board is typically inserted into the stream of sheets below the stop shaft mentioned at the outset. But then, no matter how close together the stop shaft and the rake, for instance, are, there is a region in which the stop faces, pointing upward in their working position relative to the stop shaft, of the stops carried by the stop shaft exert no orienting effect on the leading edges of the sheets. It is in fact possible for individual sheets of the partial stack forming on the rake to slip into a gap between the rake and the stop shaft.

In the above-mentioned printing presses sold by Heidelberger Druckmaschinen, model number SM102, this nuisance is counteracted by means of strippers, which are positioned on the stop shaft wherever a bar of the rake, inserted counter to the direction of travel of the sheets through the printing press, is located below the stop shaft. These strippers are wedge-shaped and rest with the tip of the wedge on a given rake bar and thus close the aforementioned gap between the rake and the stop shaft.

If a pallet provided with grooves, in such a way that the partial stack can be lifted from the rake by means of the pallet that can be raised with the aid of the main stack lifter is used as a further stack underlay—to take over the partial stack formed on the rake—then the partial stack upon extraction of the rake from its position below the partial stack remains untouched thereby, so that the aforementioned wedgelike strippers make a sufficient contribution to forming an overall flat face end of a given stack in a so-called nonstop operating mode of a delivery system.

From German Patent DE 29 35 710 C2, it is also known, in a delivery system operating in the nonstop mode and embodied with a rake for temporarily carrying a partial stack formed on it, in which the rake is inserted into the stream of sheets in the direction of sheet travel through the printing press, to dispose stops on a face end of the stack located upstream in terms of the direction of sheet travel through the printing press, whose stop faces point downward with respect to a stop shaft that carries the stops. The rake bars, embodied here in the form of telescoping tubes, are located, when they gave been inserted into the stream of sheets, in gaps between the stops, so that for the edges of the sheets oriented toward these stops, a corner is formed that is quasi-closed, because it is impenetrable on the one hand by the rake bars and on the other by the stop faces.

Such stop systems—with a stop shaft located at the top—are inferior, however, to the stop system with the bottom stop shaft mentioned at the outset, because they involve the risk of shifting of the associated side of the stack toward the stop faces. Specifically, the stacking of sheets on one another takes place below the stop shaft, while conversely in systems with a bottom stop shaft this process takes place above it and thus each stack layer in the course of the aforementioned lowering of the stack, which is adapted to the cadence of the successive sheets, moves past the stop faces in a region thereof where because of their closeness to the stop shaft they form a relatively rigid configuration. This is not the case, however, in stop systems with a stop shaft located at the top.

SUMMARY OF THE INVENTION

It is accordingly an object of the invention to provide a an apparatus for forming stacks of a stream of successive sheets, which overcomes the above-mentioned disadvantages of the heretofore-known devices and methods of this general type and which provides for a stop system that assures flat stack face ends without interrupting the stream in so-called nonstop operation, both when a stack is built up successively and when a subsequent stack is formed.

With the foregoing and other objects in view there is provided, in accordance with the invention, an apparatus for forming stacks from a stream of successively arriving sheets, comprising:

rotary bearing parts defining a geometric pivot axis at a predetermined level and oriented crosswise to a direction of a stream of sheets;

a carrier profile disposed parallel to the geometric pivot axis and eccentrically relative to the rotary bearing parts;

a stop face configuration carried on the carrier profile primarily above the geometric pivot axis and pivotable about the geometric pivot axis between a working position for stopping sheets of the stream of sheets and a position pivoted away from the working position;

the stop face configuration having stop face segments projecting downward in a comblike fashion past the carrier profile in the working position of the stop face configuration.

In this first variant of the inventive concept, therefore, the apparatus described at the outset is equipped with a carrier profile that is parallel to the geometric pivot axis and is disposed eccentrically relative to the rotary bearing parts. The carrier profile carries the stop face configuration and the stop face configuration has stop face segments which protrude downward in comblike fashion past the carrier profile in the working position.

The expression "primarily above" as used herein is synonymous with "essentially above" and "substantially above."

In accordance with an added feature of the invention, the stop face configuration, in the working position thereof, extends to below the predetermined level of the geometric pivot axis and being formed below the predetermined level enabling the stop face configuration to be pivoted between the working position and the position pivoted away from the working position without engaging in a respective stack.

With the above and other objects in view there is also provided, in accordance with a second variant of the inventive concept, an apparatus for forming stacks from a stream of successively arriving sheets, comprising:

a stop face configuration disposed primarily above a defined geometric pivot axis and pivotable thereabout between a working position for stopping sheets arriving in a stream of successive sheets and a position pivoted away from the working position, the geometric pivot axis extending at a predetermined level crosswise to a direction of the stream of successive sheets;

a carrier profile extending parallel to the geometric pivot axis, the carrier profile being vertically adjustable between an outset position located a given distance below the geometric pivot axis and further positions located below the outset position; and a plurality of auxiliary stops carried by the carrier profile and protruding upward past the carrier profile.

In the second variant of the invention, therefore, the apparatus is equipped with a carrier profile that extends parallel to the geometric pivot axis and carries auxiliary stops. The carrier profile is vertically adjustable between an outset position located at a distance below the geometric pivot axis and positions located below this outset position, and the auxiliary stops in the outset position span the distance between the carrier profile and the geometric pivot axis.

In accordance with another feature of the invention, the given distance between the carrier profile, in the outset position thereof, and the geometric pivot axis is adjustable.

It is a common feature of both variants that by means of a lowerable rake that can be inserted between successive sheets—specifically by means of tops of grid bars forming the rake—on the one hand and by means of stop faces of the apparatus on the other, a corner can be created which is impenetrable by the edges of the sheets oriented toward the stop faces, in a way that in the prior art (cf. German Patent DE 29 35 710 C2, above) was attainable only with a stop system having a stop shaft located at the top.

In a position pivoted away from the working position by a certain pivot angle, in which position the stop face configuration assumes an at least substantially horizontal position, this configuration enables access to the stack, so that an operator can reach without hindrance through stops between two successive sheets and take out the next one as a specimen sheet. For this situation, a further-refined feature of the apparatus, in which the stop face segments protruding downward past the carrier profile in the working position extend to below the level of the geometric pivot axis and have a course below it that enables pivoting of the stop face configuration by the aforementioned pivot angle without intervention in a given one of the stacks, proves to be advantageous. To that end, a course concentric with the geometric pivot axis is preferably provided, which beginning at the level of the geometric pivot axis extends at least over an angle corresponding to the aforementioned pivot angle. For the case where, as a consequence of the pulling of the specimen sheet, sheets located below it have been pushed outward past the otherwise flat side face of the otherwise flat side face of the stack oriented by means of the stop face configuration, the concentric course of the stop face segments below the geometric pivot axis assures that upon the pivoting of the stop face configuration back into the working position, the shifted sheets are pushed back into an aligned position, and this is done while gently treating the edges of the sheets then acted upon by the concentric stop face segments.

With the objects of the invention in view there is also provided a sheet-fed printing press equipped with a sheet stacker according to one of the afore-described embodiments.

Other features which are considered as characteristic for the invention are set forth in the appended claims.

Although the invention is illustrated and described herein as embodied in an apparatus for forming stacks from a stream of successively arriving sheets, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWINGS

Throughout the drawing figures, functionally and structurally analogous elements are provided with the same reference numerals even if their geometry differs from one to another.

DESCRIPTION OF THE PREFERRED EMBODIMENTS

Figures 1, 1A:
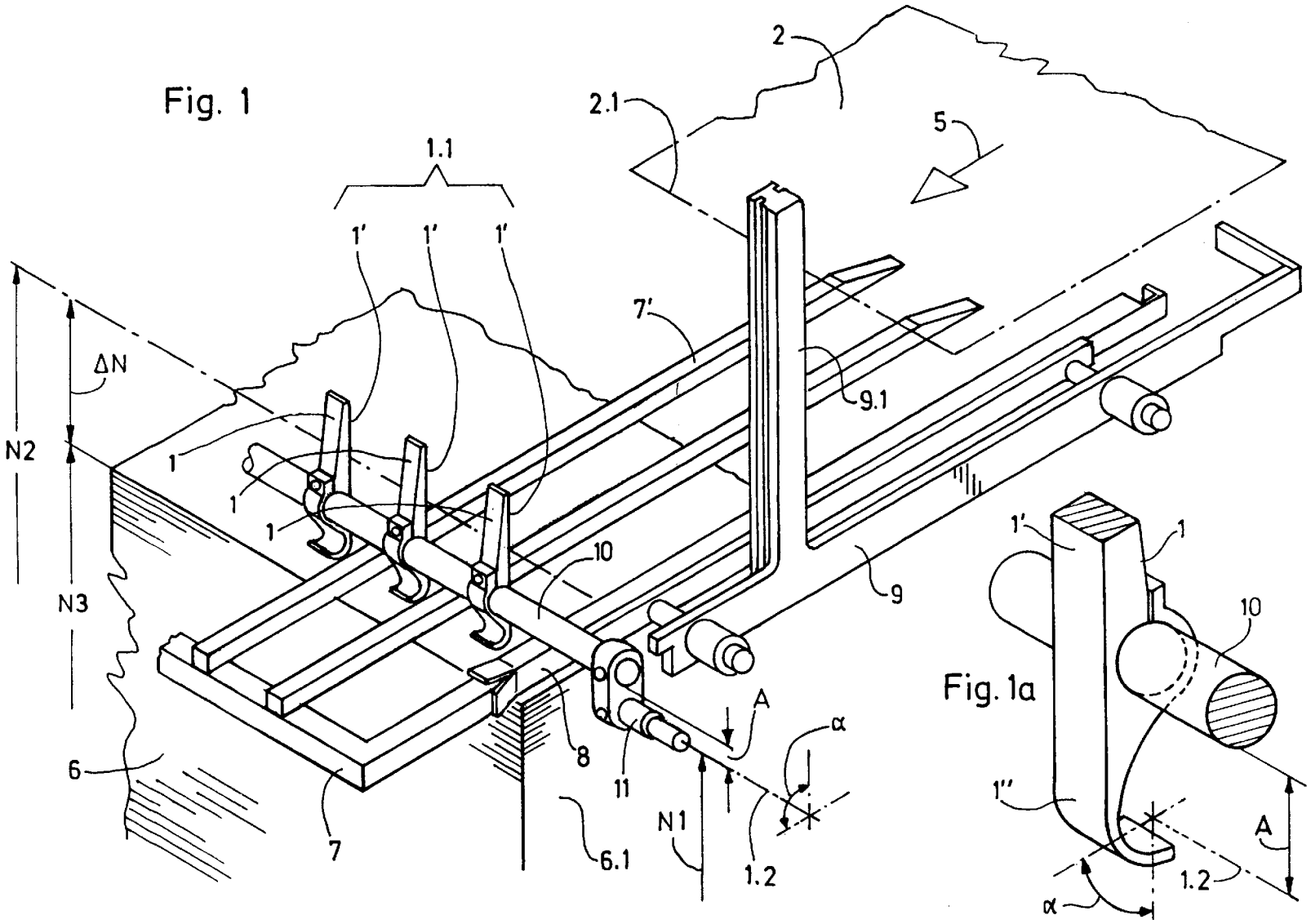
FIG. 1 is a perspective detail of a first embodiment of the sheet-stacking apparatus in which the stop face configuration is formed with discrete stop faces.
FIG. 1*a* is a perspective view of a detail of the carrier profile carrying the stop face configuration, seen from a different direction than in FIG. 1.

Referring now to the figures of the drawing in detail and first, particularly, to FIGS. 1 and 1*a* thereof, there is seen a first embodiment with a plurality of discrete stops 1. Each of the stops 1 has a stop face 1' (cf. FIG. 1*a*). The several discrete stops 1 together form a stop face configuration 1.1. With respect to a geometric pivot axis 1.2, the stop face configuration can be pivoted between the illustrated vertical working position, and a position pivoted away from it. In the working position the stop face configuration 1.1 stops the sheets 2 that succeed one another in a steady stream during operation. The geometric pivot axis 1.2, defined by the rotary bearing parts 11, is disposed at a predetermined level N1 and is oriented crosswise to the direction of the stream of sheets 2. In a use of the apparatus, shown in FIGS. 4–6, in a delivery system 3 of a printing press that handles the sheets 2, the stream of sheets 2 is maintained by means of revolving gripper systems 3.1, which by gripping a given sheet 2 in the region of its leading edge 2.1 take the sheet over from a final processing station 4 of the printing press, guide it along a sheet guide device 3.2 that typically forms an air cushion below the sheet 2, and transfer it to a sheet brake 3.3. The sheet brake releases a given sheet 2 after the sheet has been braked to a deposition speed, so that the sheet moves—while being lowered at the same time—toward the stop face configuration 1.1, as indicated by the directional arrow 5 in FIG. 1, and finally, at a production level N2 that is kept substantially constant, rests as the topmost sheet on a stack 6 formed of the sheets 2.

Figure 4:
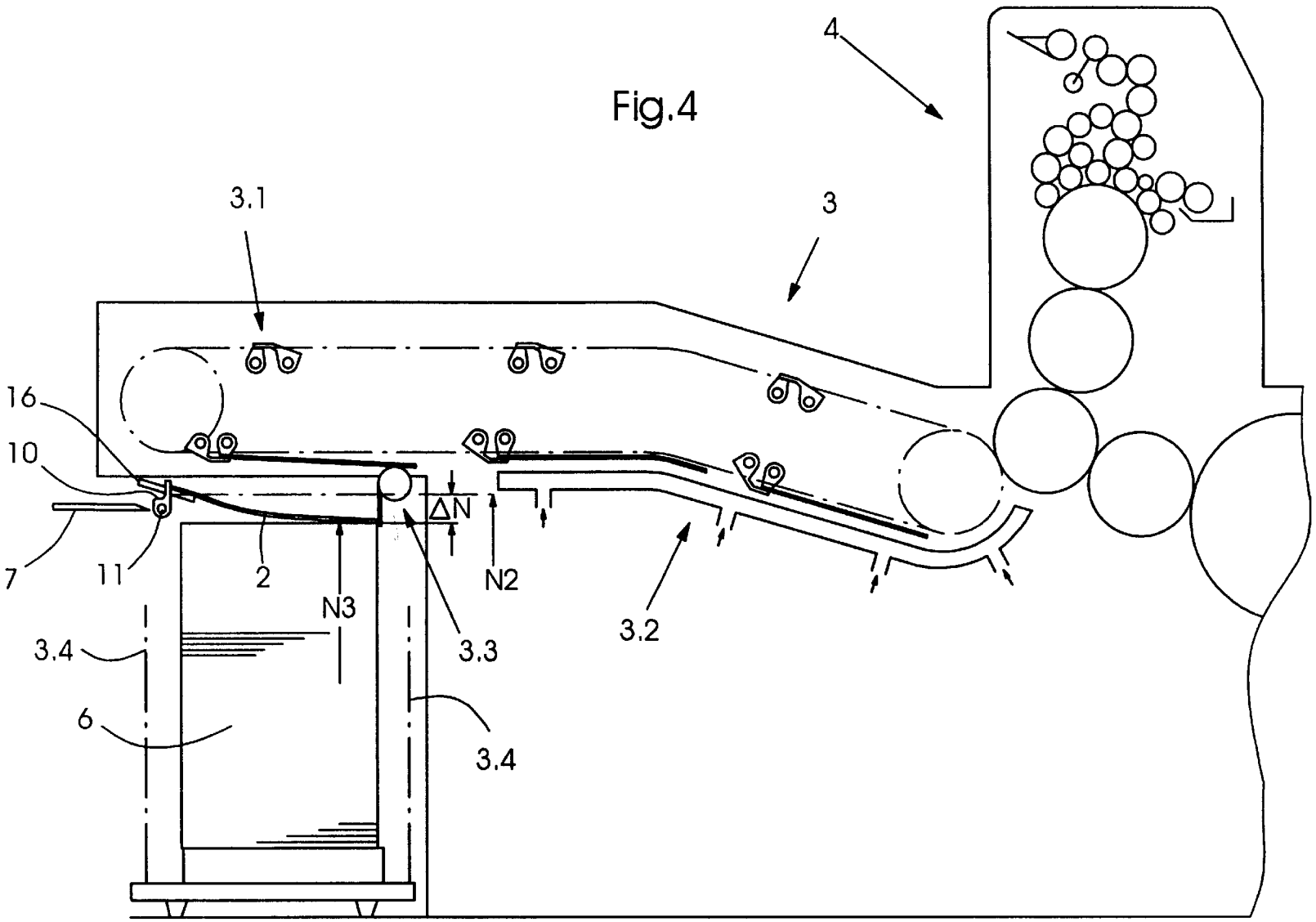
FIG. 4 is a schematic side view of a delivery end of a sheet-fed printing press that includes a delivery system, one phase of a stack change, taking as an example the use of the second embodiment of the apparatus.
Figure 5:
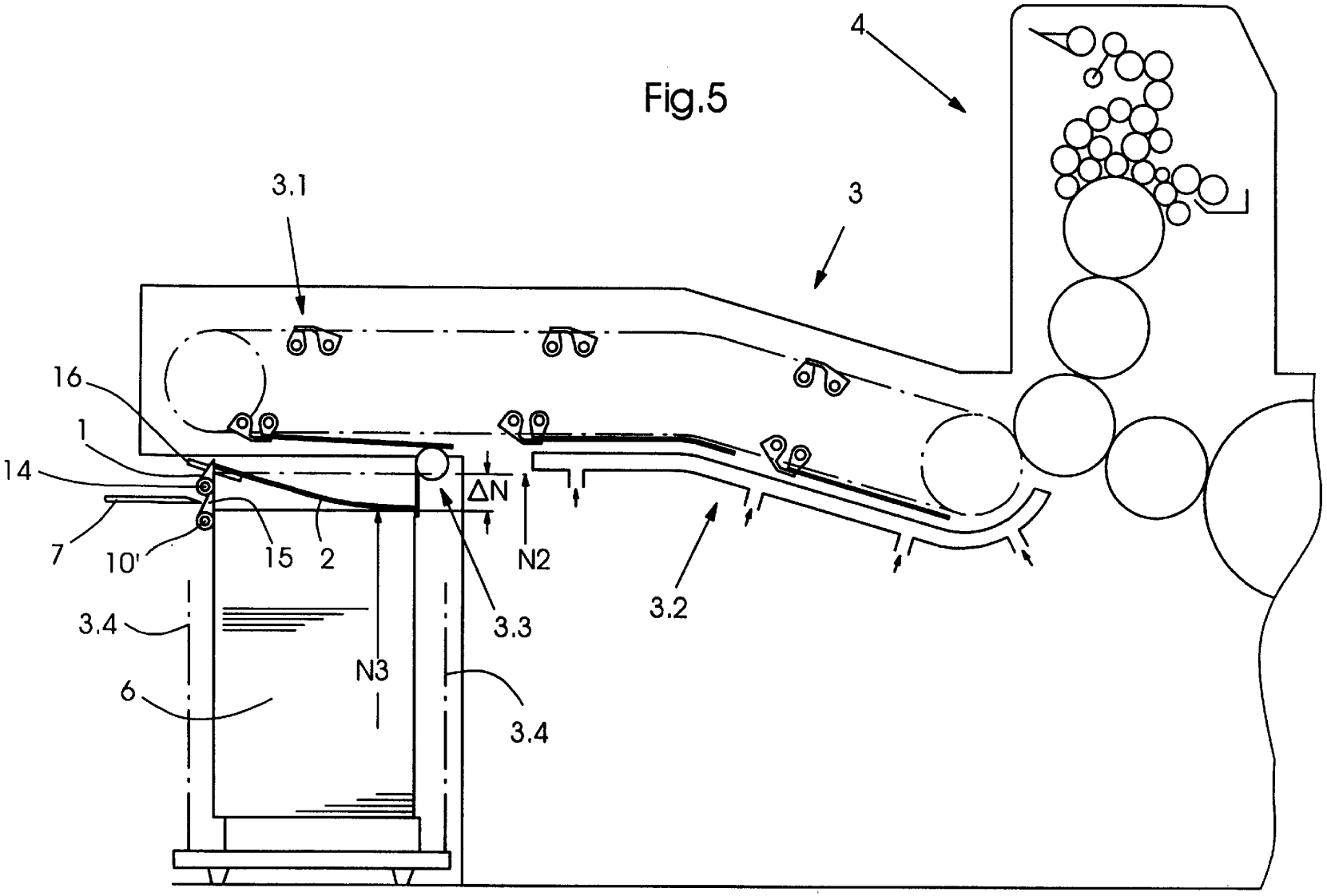
FIG. 5 is a schematic view similar to FIG. 4, of a phase of a stack change taking as an example the use of the second embodiment of the apparatus, wherein the stack is changed with the aid of a rake that temporarily carries a partial stack.
Figure 6:
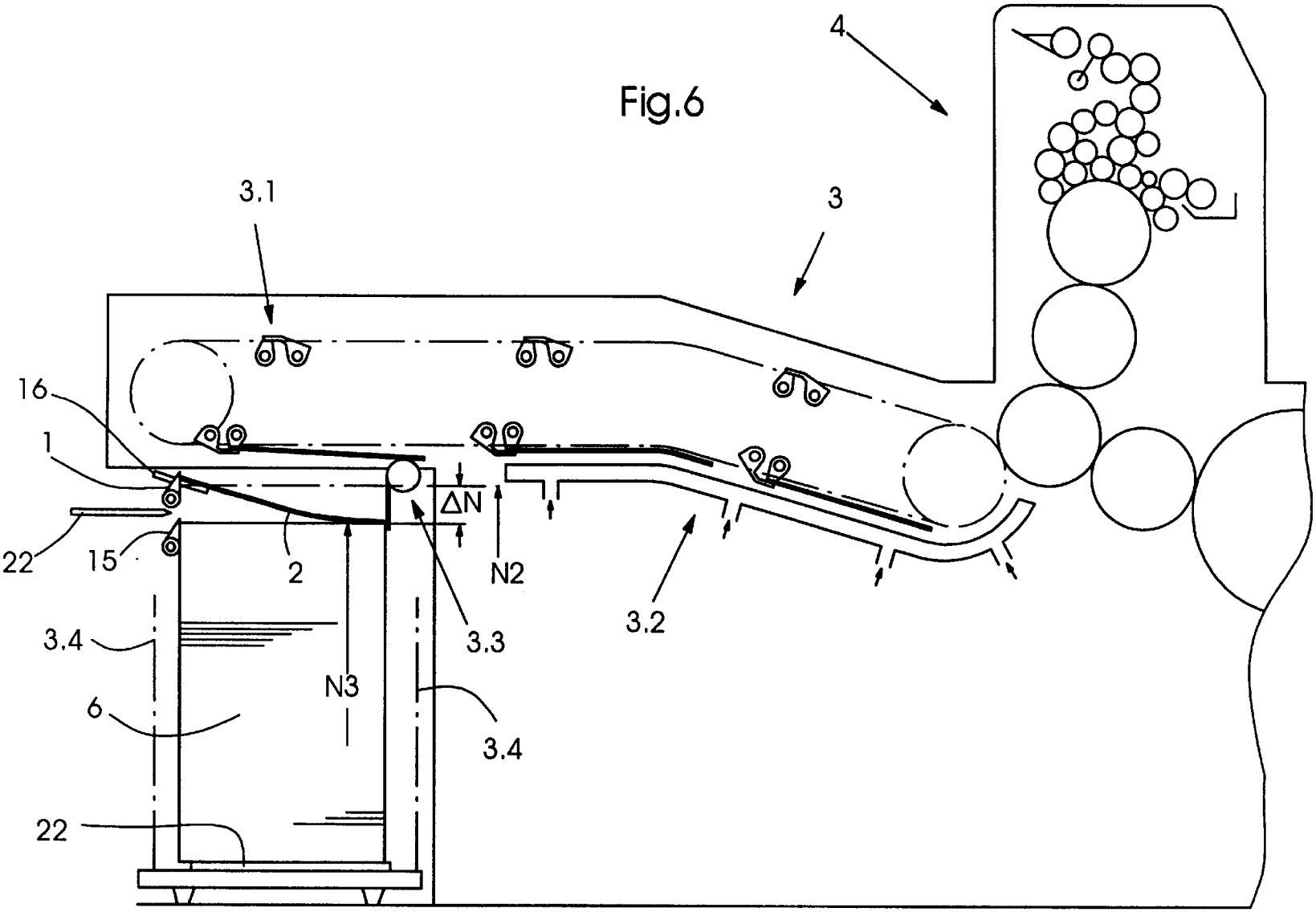
FIG. 6 is a further schematic view similar to FIG. 4, of a phase of a stack change taking as an example the use of the second embodiment of the apparatus, wherein the stack is formed on a board.

The maintenance of the production level N2 is accomplished by means of the main stack lifter, which is represented in suggested form in FIGS. 4–6 by lifting chains 3.4 shown in dot-dashed lines.

In this way, a stack 6 builds up. Once it has reached a certain height, sheet upholders, not shown in FIG. 1, in the region of the stops 1 are moved into the stream of sheets 2, and thus a trailing sheet 2 is prevented, in the region of its leading edge 2.1, from dropping down onto the stack 6. Optionally, the sheet upholders are embodied as suction grippers.

FIG. 1 shows the stack 6 in a position that has been lowered by a certain level different ΔN, in which position the topmost sheet 2 of the stack 6 assumes a level N3 that is located lower than the production level N2.

In the exemplary embodiment shown in FIG. 1, the sheet 2, held by means of the sheet upholders that are not shown here, and other sheets 2 trailing it and deposited on it, are caught from below by rake 7, so that the stack 7 can be removed. To that end, a horizontal guide 8 into which the rake 7 can be inserted is associated with a given side face 6.1 of the stack and is parallel to that side face 6.1. A given guide 8 is carried by an adjustable-height frame 9. To adjust its height, the frame 9 is equipped with a vertical guide rail 9.1, which is adjustable by means of an auxiliary stack lifter along guide means, not shown.

The sheets 2 upheld until the insertion of the rake 7 has been completed are stopped by means of further stops, not shown, on which further stop faces aligned with the stop faces 1' are embodied. Once the rake 7 has been inserted, the sheet upholders move back to an outset position assumed before they had moved into the stream of sheets 2, so that the sheet engaged by the sheet upholders and the sheets 2 deposited in it in the meantime are lowered, in their regions adjacent to the leading edges, onto the rake 7, once the sheet 2, engaged by the sheet upholders and initially still resting on this stack 6 in the region of its trailing edge, is peeled off from the stack 6 by the rake 7 and raised, together with the further sheets resting on the peeled-off sheet, to the level on the top of the rake 7.

While the sheet 2 is being lowered in the region of its leading edges 2.1 and immediately thereafter, these edges are then aligned with the stop face configuration 1.1, the predominant portion of which is located above the geometric pivot axis 1.2. This location of the stop face configuration 1.1 is dictated not only in its vertical working position shown in FIG. 1 but also in a position, assumed for pulling out specimen sheets, that is pivoted away from the working position relative to the geometric pivot axis 1.2 and that is attained, in terms of what is shown in FIG. 1, by counterclockwise pivoting by a pivot angle α to a substantially horizontal position of the stop face configuration 1.1.

Eccentrically to the geometric pivot axis 1.2 (at a distance A from it in the present example), a carrier profile 10 extending parallel to it is provided, which carries the stop face configuration 1.1 that is pivotable relative to the geometric pivot axis, so that the carrier profile 10 in turn is pivotable relative to the geometric pivot axis 1.2. In the pivoted position of the stop face configuration 1.1 as shown in FIG. 1, this configuration is in the working position. The stop face configuration 1.1 includes stop face segments 1", which protrude downward in comblike fashion past the carrier profile 10 in the aforementioned working position. In the present example, a given one of the stop face segments 1" is a part, located below the carrier profile 10 in the working position, of a given one of the stop faces 1' embodied on the discrete stops 1. The comblike configuration is the result of the lining up of discrete stops 1 along the carrier profile 10.

The geometric pivot axis 1.2 is represented, in the present example in FIG. 1, by a common axis of rotation of aligned rotary bearing parts 11 in the form of trunnions, secured to a given end of the carrier profile 10 via a respective double bend, and by means of which trunnions the carrier profile 10 and thus the stop face configuration 1.1 is received in bearings, not shown, so that they can be pivoted relative to the geometric pivot axis 1.2. The geometric pivot axis 1.2 therefore represents merely an imaginary line along the carrier profile 10, so that the rake 7 can be inserted directly below the carrier profile 10. A given stop face 1'—including its stop face segment 1"—is a flat, vertical face that is parallel to the leading edges 2.1 of the sheets 2 and that in the working position is above the geometric pivot axis 1.2. In other words, the stop face 1' extends as a flat face from one end, located above the carrier profile 10 in the working position, to below the carrier profile 10 in the present example. Thus in the working position, a plane defined by the top side of the rake 7 inserted directly below the carrier profile 10 intersects a plane defined by the stop faces 1' of the stop face configuration 1.1; the stop face configuration 1.1 extends both above and below the line of intersection of these two planes. These two planes also intersect one another at right angles, so that the leading edges 2.1 of all the sheets 2 placed on the rake 7 form an exactly aligned end face of the partial stack formed of these sheets 2.

This result is also attained, however, whenever the eccentric disposition of the carrier profile 10 is selected such that in the working position, the lowermost points of the cross-sectional contour of the carrier profile 10 are no lower than the level N1 of the geometric pivot axis 1.2.

A result that is still adequate for practical purposes is attained even if the level N1 is undershot. Because of the stop face configuration 1.1 that protrudes in comblike fashion downward past the carrier profile 10 in the working position, this configuration, together with the rake 7 inserted directly below the carrier profile 10, still forms a corner that is impenetrable to the sheets 2 even if it is no longer exactly a right angle, since the stop face configuration 1.1, in the working position, below the level N1, preferably has a concentric course to the geometric pivot axis 1.2, a course that beginning at the level N1 extends over at least an angle equivalent to the pivot angle α.

It is advantageous to dimension the stop face segments 1" in such a way that in the working position they extend to below the level N1 of the geometric pivot axis 1.2 and have the aforementioned concentric course there, even whenever a spacing is provided between the carrier profile 10 and the geometric pivot axis 1.2. The advantage of this has already been discussed above in conjunction with the explanation of the position of the stop face configuration 1.1 pivoted away from the working position so that specimen sheets can be taken. A corresponding dimensioning of the stop face segments 1" is also provided in the example of FIG. 1 and is best seen in FIG. 1*a*.

An actuator optionally engaging a rotary bearing part 11 embodied as a trunnion and intended for pivoting the stop face configuration 1.1 is not shown, for the sake of simplicity.

In the exemplary embodiment of FIG. 1, the carrier profile 10 is embodied as a round bar, and the stop face configuration 1.1 is composed of discrete stop faces 1', which are embodied on stops 1 joined to the round bar.

However, the stop face configuration 1.1 can also be embodied integrally as a component of the carrier profile 10.

Figure 2:
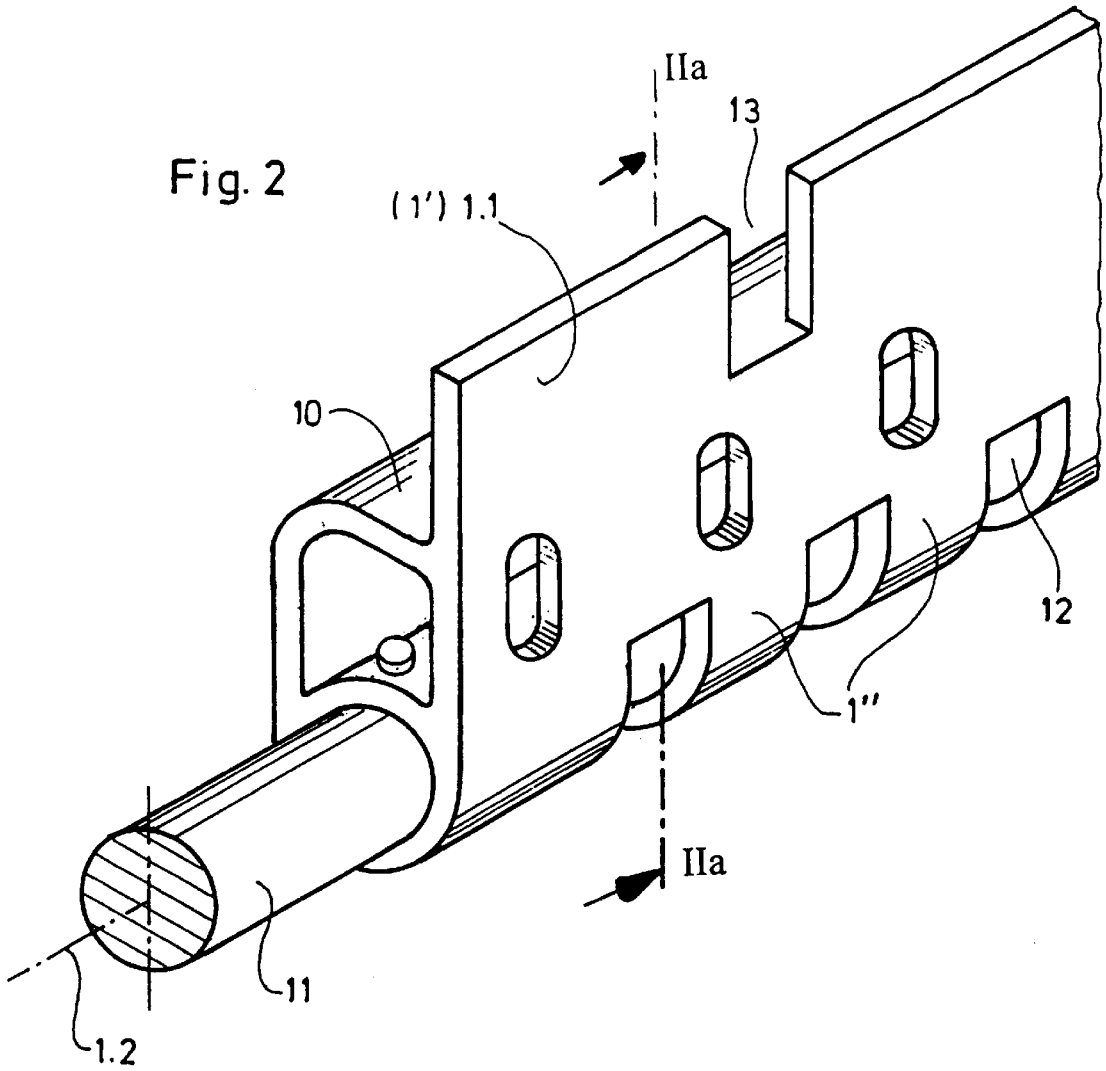
FIG. 2 is a perspective view of a detail of a further variant of the first exemplary embodiment in which the stop face configuration is embodied integrally.
Figure 2A:
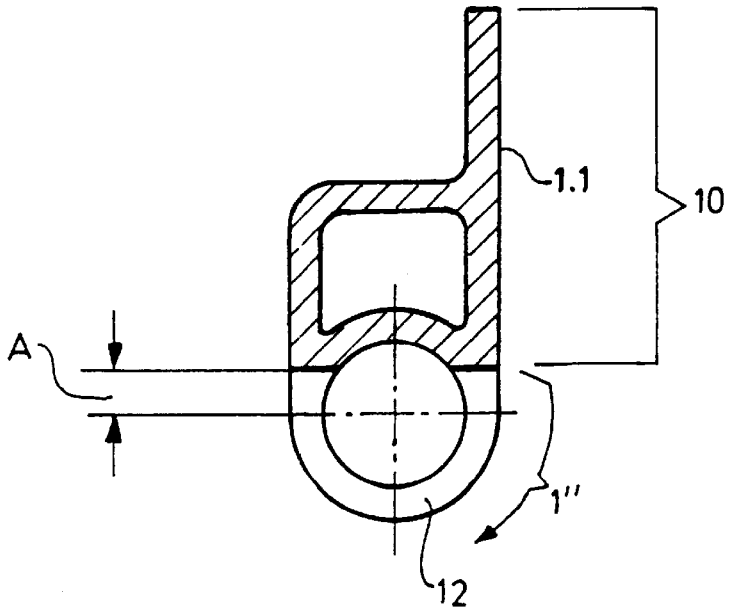
FIG. 2*a* is a sectional view taken along the line IIa–IIa in the perspective view of FIG. 2.

In FIG. 2, a corresponding exemplary embodiment is shown in the working position, that is, with a vertically oriented stop face configuration 1.1. This configuration represents a cohesive stop face 1', whose stop face segments 1" protruding downward in comblike fashion past the carrier profile 10 in the working position are formed on remaining components between recesses 12, which succeed one another along the carrier profile 10 in the stop face configuration 1.1 in its region toward the bottom in the working position.

In the upper region, in the working position, of the stop face configuration 1.1, recesses 13 are also provided. They allow the sheet upholders, mentioned earlier, to be moved into the stream of sheets 2.

The geometric pivot axis 1.2 in the exemplary embodiment of FIG. 2 is embodied analogously to that of FIG. 1 by a common axis of rotation of aligned rotary bearing parts 11 embodied as trunnions, which on a given end of the carrier profile 10 are firmly joined to the carrier profile 10, in the present example by means of pinning.

In the present example, a profile that includes a hollow profile is provided as the carrier profile 10. Walls surrounding its hollow cavity form part of the profile on which the stop face configuration 1.1 is embodied, including its stop face segments 1" that protrude downward in comblike fashion past the carrier profile 10 in the working position.

In the upper region, in the working position, of the stop face configuration 1.1 a further recess, not shown, is expediently provided; where a specimen sheet is to be taken out of the stream, it makes manual access to the sheets 2 being lowered onto the stack 6 easier. In that case, a lowering of the sheets 2 can be grasped by hand without significant hindrance from the stop face configuration 1.1 and then pulled, after the stop face configuration 1.1 has temporarily been pivoted away from its working position.

Figures 3, 3A, 3B:
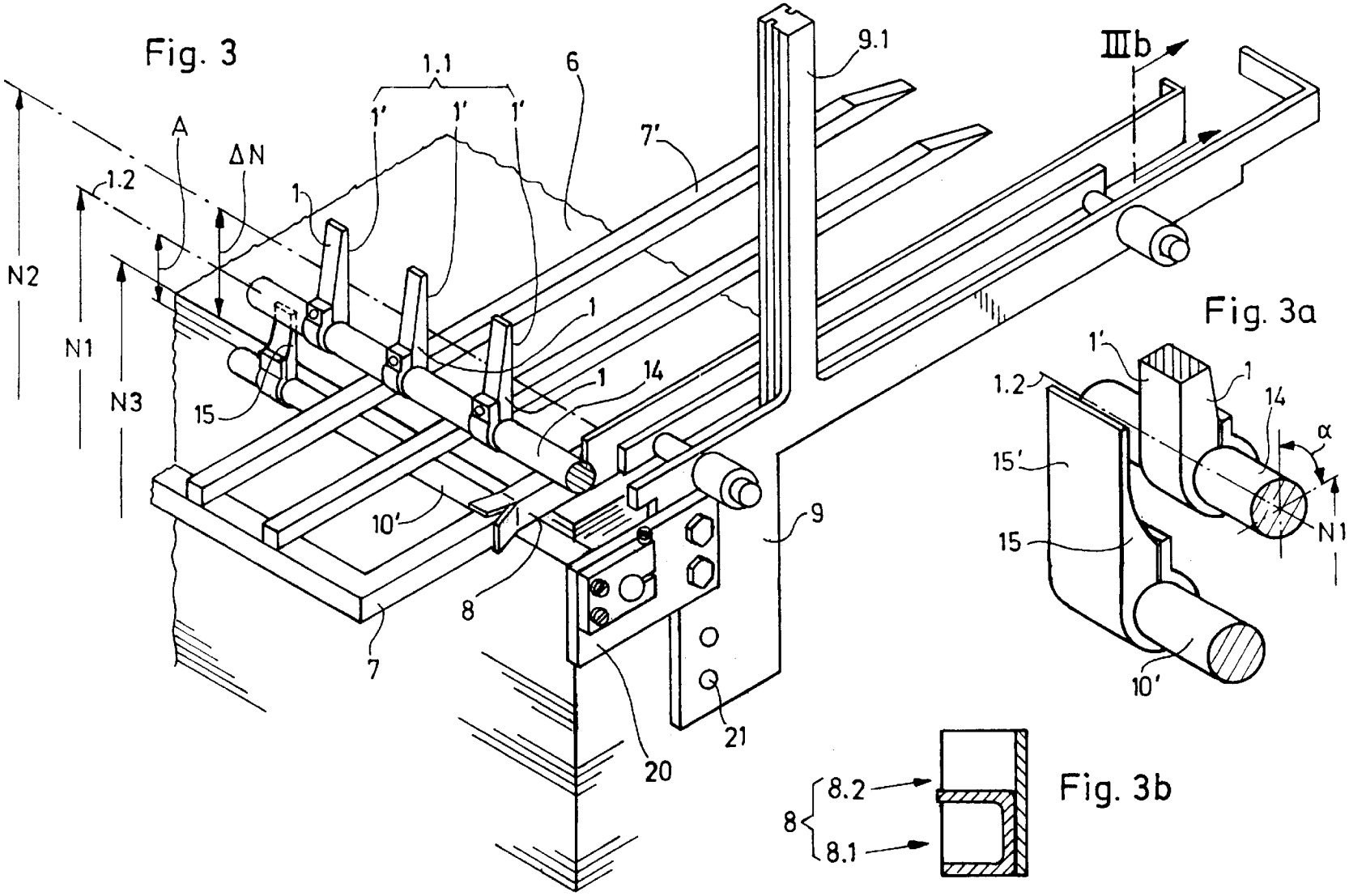
FIG. 3 is a perspective of a portion of a second embodiment of the apparatus in which the stop face configuration is again formed by discrete stop faces.
FIG. 3*a* is a partial perspective view of a detail of the apparatus of FIG. 3, seen from a different direction.
FIG. 3*b* is a cross section of a guide for stack underlays, configured for alternative stacking modes.

In a second variant of the apparatus, shown in FIG. 3, the geometric pivot axis 1.2 is in the conventional way in the form of a longitudinal axis, located at a predetermined level N1 and oriented crosswise to the direction of the stream, of a stop shaft 14, which carries a stop face configuration 1.1 that is pivotable relative to the geometric pivot axis 1.2 between a vertical working position that stops the sheets 2 and a position pivoted away from the working position, and that is formed by means of stops 1, connected to the stop shaft 14, at each of which stops a stop face 1' is formed, as can be seen from a different direction in FIG. 3*a*. As can also be seen from FIG. 3*a*, the stop faces 1' are located substantially above the geometric pivot axis 1.2, specifically both in the vertical working position of the stop face configuration 1.1 that is shown in FIGS. 3 and 3*a* and that stops the sheets, and in a position pivoted away from the working position by the angle $\alpha$ and intended for the taking of specimen sheets.

At a spacing A, defining an outset position, from the geometric pivot axis 1.2, a carrier profile 10' extending parallel to the geometric pivot axis is located below it; it carries auxiliary stops 15 and is vertically adjustable between the aforementioned outset position and positions located below it. To that end, the carrier profile 10 is carried by a frame 9, provided analogously to the example of FIG. 1, which for its height adjustment is equipped with a vertical guide rail 9.1 that is adjustable along guide means, not shown, by means of an auxiliary stack lifter, also not shown.

The auxiliary stops 15, only one of which is shown in FIG. 3, protrude past the carrier profile 10' upward. To perform an auxiliary function intended for the auxiliary stops 15, auxiliary stop faces 15' are formed on them, which are located in one and the same plane as the stop faces 1' of the stops 1 in the working position. With this arrangement, it is now possible to dispose the auxiliary stops 15 in gaps between the stops 1, and as seen in FIG. 3*a* to design the geometry of the auxiliary stops 15 in such a way that a respective upper end of its auxiliary stop faces 15' is located above a lower end of the stop faces 1' of the stops 1.

If a sheet upholder has now been inserted between two successive sheets in the region of their leading edges 2.1, and if the stack 6 that has grown up to that point is lowered, by a main stack lifter, not shown, from the production level N2 to a lower level N3 of its uppermost sheet by a sufficient level difference $\Delta N$, then a rake 7 that temporarily carries the upheld sheet and other sheets deposited on it can be inserted, guided in horizontal guides 8 carried by the frame 9, into gaps between the auxiliary stops 15 between the stop shaft 14 and the carrier profile 10' in its outset position. If the sheet upholders now return to an outset position assumed before they were inserted into the stream of sheets, then the sheet initially held up and the sheets deposited on it in the mean time are lowered, in their regions adjacent to leading edges 2.1, onto the rake 7, once the sheet 2, gripped by the sheet upholders and initially still resting on the stack 6 in the region of its trailing edge, has been peeled off from the stack by the rake 7 and raised, together with the further sheets resting on the peeled-off sheet, to the level of the top side of the rake 7. During the lowering of the sheets 2 in the region of their leading edges 2.1, these edges are first aligned at the stop faces 1' of the stops carried by the stop shaft 14, and at least a lowermost part of the sheets meanwhile stacked up to form a partial stack is finally aligned with the stop faces 15' of the auxiliary stops 15. As seen particularly in FIG. 3*a*, the stop faces 1' and 15' mesh with one another, so that the leading edges 2.1 of the sheets being lowered always find at least one of the stop faces 1' and 15'.

The stop faces 15', with respect to the top side of the inserted rake, extend both above and below this top side and moreover are perpendicular to it, so that the leading edges 2.1 of all the sheets 2 deposited on the rake form an exactly aligned end face of the partial stack formed from this sheet.

If the height of this partial stack exceeds the spacing of the production level N2 from the top side of the rake 7 before the partial stack, by the extraction of the rake 7 between the partial stack and a further stack underlay, carried by the main stack lifter and raised to a transfer level, has been transferred to this stack underlay, then typically an auxiliary stack lifter, not shown here, lowers the rake 7 to an extent equivalent to the increase in height of the partial stack. To that end, the frame 9 that carries both the guide 8 for the rake 7 and the carrier profile 10' is suspended, in a manner not shown, from the auxiliary stack lifter so that the carrier profile 10' is also lowered by the aforementioned extent and, with vertical adjustment thereof, assumes positions located below its outset position. Because of the joint lowering of the rake 7 and carrier profile 10', these elements maintain their mutual position. Thus, the auxiliary stops 15' act not only as alignment means for forming a flat face end of a stack but also restraining means, which when the rake is pulled in the course of the transfer of the partial stack to a further stack underlay, which may possibly not be provided with grooves for receiving the bars 7' of the rake 7, secure the lowermost sheets of the partial stack from slipping.

In the present exemplary embodiment, the carrier profile 10' is received on a given end thereof in a carrier plate 20, which in turn is separably connected to the frame 9. The separable connection can be made in various vertical positions of the carrier plate 20 relative to the frame 9. To that end, the frame 9 is provided with a corresponding arrangement of securing bores 21. Thus the spacing provided in the outset position of the carrier profile 10' between the carrier profile 10' and the geometric pivot axis 1.2 is adjustable.

In the event of a stack change with the aid of a rake that temporarily carries a partial stack—in this case, the rake 7 of FIG. 2—this spacing is set in such a way, taking into account the cross section of the bars 7' forming the rake and the vertical length of the auxiliary stop faces 15', that on the one hand the rake 7 is insertable between the stop shaft 14 and the carrier profile 10', and on the other the stop faces 1' and the auxiliary stop faces 15' partly overlap—as can be seen particularly from FIG. 3*a*.

In the exemplary embodiment of FIG. 3, the guide 8 carried by the frame 9 has a U-shaped receiving profile 8.1 for the rake and an L-shaped receiving profile 8.2 for a board intended as a stack underlay. In combination with the above-explained adjustability of the vertical position of the bearing plate 20 relative to the frame 9, this makes it possible to adjust an outset position of the carrier profile 10' at a spacing A from the geometric pivot axis 1.2 that is increased compared with FIG. 3, so that immediately below the stop shaft 14 and immediately above the auxiliary stops 15, a board 22 (see FIG. 6), as a stack underlay for a further stack, can be inserted between a sheet upheld by a sheet upholder 16 and the lowered stack. The described provision should be adapted to one another in such a way that the auxiliary stop faces 15' are still operative in the surroundings of the uppermost sheet on the lowered stack 6.

In the case where a further stack is formed on the board 22 acting as a stack underlay, this board is not extracted again from below a partial stack as in the case of a stack change with the aid of a rake; however, the effect does occur that at least the topmost sheet 2 of the lowered stack 6 snaps counter to the insertion direction after the board 22 has been inserted. Any influence of this effect on the alignment of the sheets 2 in the stack 6 is averted, however, with the auxiliary stops 15.

The delivery system 3, shown in FIG. 4, of a printing press that processes the sheets 2 is equipped with the exemplary embodiment of the apparatus, explained in conjunction with FIG. 2, in accordance with the first variant thereof. It is schematically shown in a phase of stack formation in which the sheet upholders 16 have been moved between two successive sheets 2 and the finished stack 6 has been lowered by the level difference ΔN, so that the topmost sheet of the stack 6, which sheet has previously been placed at the production level N2, is located at the lower level N3 and has thus made the way clear for insertion of the rake 7 between the finished stack 6 and the next following sheet 2.

FIGS. 5 and 6 each schematically show the same snapshot as FIG. 4, but the delivery system 3 shown in them is equipped with the second variant of the apparatus as explained in conjunction with FIGS. 3, 3*a* and 3*b*. As equipped according to FIG. 5, the outset position shown there of the carrier profile 10' is adapted as already explained to the stack change with the aid of a rake—in this case the rake 7—while when equipped as in according to FIG. 6, the outset position shown there for the carrier profile 10' is adapted, again as already explained, to the buildup of a further stack on a board—in this case, the board 22'.

To set the outset position of the carrier profile 10', that is, the spacing A provided in the outset position of the carrier profile between the carrier profile and the geometric pivot axis 1.2, it is possible, instead of the described conversion of the bearing plate 20 that receives the carrier profile 10' to different heights relative to the frame 9, also to provided a vertical guide for the bearing plate 20 on the frame 9 and to provide adjusting means that adjust the bearing plate along this vertical guide.

We claim:

1. An apparatus for forming stacks from a stream of successively arriving sheets, comprising:

rotary bearing parts defining a geometric pivot axis at a predetermined level and oriented crosswise to a direction of a stream of sheets;

a carrier profile disposed parallel to said geometric pivot axis and eccentrically relative to said rotary bearing parts;

a stop face configuration carried on said carrier profile primarily above said geometric pivot axis and pivotable about said geometric pivot axis between a working position for stopping sheets of the stream of sheets and a position pivoted away from the working position;

said stop face configuration having stop face segments projecting downward in a comblike fashion past said carrier profile in the working position of said stop face configuration.

2. The apparatus according to claim 1, wherein said stop face configuration, in the working position thereof, extends to below the predetermined level of said geometric pivot axis and being formed below the predetermined level enabling said stop face configuration to be pivoted between the working position and the position pivoted away from the working position without engaging in a respective stack.

3. In combination with a delivery system of a sheet-fed printing press, the apparatus according to claim 1.

4. An apparatus for forming stacks from a stream of successively arriving sheets, comprising:

a stop face configuration disposed primarily above a defined geometric pivot axis and pivotable thereabout between a working position for stopping sheets arriving in a stream of successive sheets and a position pivoted away from the working position, said geometric pivot axis extending at a predetermined level crosswise to a direction of the stream of successive sheets;

a carrier profile extending parallel to said geometric pivot axis, said carrier profile being vertically adjustable between an outset position located a given distance below said geometric pivot axis and further positions located below the outset position; and a plurality of auxiliary stops carried by said carrier profile and protruding upward past said carrier profile.

5. The apparatus according to claim 4, wherein said given distance between said carrier profile, in the outset position thereof, and the geometric pivot axis is adjustable.

6. In combination with a delivery system of a sheet-fed printing press, the apparatus according to claim 4.

* * * * *